US009037356B2

(12) United States Patent
Kawasaki et al.

(10) Patent No.: US 9,037,356 B2
(45) Date of Patent: May 19, 2015

(54) CONTROL DEVICE FOR HYBRID CONSTRUCTION MACHINE

(75) Inventors: Haruhiko Kawasaki, Atsugi (JP); Masahiro Egawa, Kawaguchi (JP)

(73) Assignee: KAYABA INDUSTRY CO., LTD., Tokyo (JP)

( * ) Notice: Subject to any disclaimer, the term of this patent is extended or adjusted under 35 U.S.C. 154(b) by 772 days.

(21) Appl. No.: 13/143,750

(22) PCT Filed: Jul. 2, 2010

(86) PCT No.: PCT/JP2010/061650
§ 371 (c)(1),
(2), (4) Date: Jul. 8, 2011

(87) PCT Pub. No.: WO2011/004881
PCT Pub. Date: Jan. 13, 2011

(65) Prior Publication Data

US 2011/0270498 A1 Nov. 3, 2011

(30) Foreign Application Priority Data

Jul. 10, 2009 (JP) ..... 2009-164278

(51) Int. Cl.
*E02F 9/22* (2006.01)
*F15B 21/14* (2006.01)
*E02F 9/20* (2006.01)

(52) U.S. Cl.
CPC ..... *E02F 9/2235* (2013.01); *E02F 9/2075* (2013.01); *E02F 9/2217* (2013.01); *E02F 9/2292* (2013.01); *E02F 9/2296* (2013.01); *F15B 21/14* (2013.01); *F15B 2211/20515* (2013.01); *F15B 2211/20523* (2013.01); *F15B 2211/20576* (2013.01); *F15B 2211/265* (2013.01); *F15B 2211/88* (2013.01)

(58) Field of Classification Search
USPC ..... 701/50
See application file for complete search history.

(56) References Cited

U.S. PATENT DOCUMENTS

| | | | | |
|---|---|---|---|---|
| 5,372,214 | A * | 12/1994 | Haga et al. | 180/422 |
| 6,175,805 | B1 * | 1/2001 | Abe | 701/533 |
| 6,851,207 | B2 * | 2/2005 | Yoshimatsu | 37/348 |
| 2002/0061803 | A1 * | 5/2002 | Aoki | 477/3 |
| 2002/0091034 | A1 * | 7/2002 | Nakamori et al. | 477/3 |
| 2003/0190995 | A1 * | 10/2003 | Aoki | 477/5 |
| 2005/0246082 | A1 * | 11/2005 | Miki et al. | 701/50 |
| 2007/0227802 | A1 * | 10/2007 | O'Brien, II | 180/307 |
| 2008/0038136 | A1 * | 2/2008 | O'Brien, II | 418/63 |
| 2010/0186404 | A1 * | 7/2010 | Yasufuku et al. | 60/459 |

FOREIGN PATENT DOCUMENTS

| | | | |
|---|---|---|---|
| JP | 2002-275945 | A | 9/2002 |
| JP | 2003049810 | A | 2/2003 |

(Continued)

*Primary Examiner* — Shelley Chen
(74) *Attorney, Agent, or Firm* — Rabin & Berdo, P.C.

(57) ABSTRACT

A control device for a hybrid construction machine includes a regulator that performs control such that a tilt angle of a variable volume pump increases as an exerted pilot pressure decreases. A controller switches a main switch valve such that an oil discharged from the variable volume pump is led to a regenerative hydraulic motor and switches a pilot selection valve such that a second pilot flow passage provided with a solenoid variable pressure reducing valve communicates with the regulator when all of a plurality of operation valves are determined to be in a neutral position.

5 Claims, 3 Drawing Sheets

(56) References Cited

FOREIGN PATENT DOCUMENTS

| | | | |
|---|---|---|---|
| JP | 2005-140143 | A | 6/2005 |
| JP | 2005-331007 | A | 12/2005 |
| JP | 2007-327527 | | 12/2007 |
| JP | 2009287745 | A | 12/2009 |
| WO | WO-2009145054 | A1 | 12/2009 |

* cited by examiner

CONTROL DEVICE FOR HYBRID CONSTRUCTION MACHINE

TECHNICAL FIELD

This invention relates to a control device for a hybrid construction machine that uses an electric motor as a drive source.

BACKGROUND ART

In a hybrid structure of a construction machine such as a power shovel, power is generated by rotating a power generator using a surplus output of an engine, the power is stored in a battery, and an electric motor is driven using the power of the battery so as to activate an actuator, for example. Power is also generated by rotating the power generator using energy discharged from the actuator. This power is likewise stored in the battery, whereupon the electric motor is driven using the power of the battery so as to activate the actuator (see JP2002-275945A).

Further, in a power shovel or the like, the engine is maintained in a rotating condition even when the actuator is stopped. At such times, a pump rotates together with the engine, and therefore the pump discharges a so-called standby flow.

SUMMARY OF THE INVENTION

In the conventional hybrid structure described above, the standby flow discharged from the pump during an actuator stoppage is simply returned to a tank and not therefore used effectively.

This invention has been designed in consideration of the problem described above, and an object thereof is to provide a control device for a hybrid construction machine that achieves energy regeneration by activating a power generation function through effective use of a standby flow from a pump.

This invention is a control device for a hybrid construction machine. The control device for a hybrid construction machine comprises a variable volume pump; a plurality of operation valves that control a flow of a working oil led to respective actuators from the variable volume pump; a neutral flow passage that leads the oil discharged from the variable volume pump to a tank when the operation valves are in a neutral position; a pilot pressure generating throttle provided in the neutral flow passage on a downstream side of the operation valves; a first pilot flow passage to which a pressure generated on an upstream side of the pilot pressure generating throttle is led; a regulator that performs control such that a tilt angle of the variable volume pump increases as an exerted pilot pressure decreases; an operating condition detector that detects an operating condition of the operation valves; a regenerative hydraulic motor rotated by the oil discharged from the variable volume pump; a power generator connected to the hydraulic motor; a main switch valve that leads the working oil discharged from the variable volume pump selectively to the operation valves or the hydraulic motor; a second pilot flow passage that leads a pilot pressure oil supplied from a pilot pressure source to the regulator; a pilot selection valve that connects the first pilot flow passage or the second pilot flow passage to the regulator selectively; a solenoid variable pressure reducing valve that is provided in the second pilot flow passage to be capable of variably controlling a pilot pressure led from the pilot pressure source and exerted on the regulator; and a controller that switches the main switch valve such that the oil discharged from the variable volume pump is led to the hydraulic motor and switches the pilot selection valve such that the second pilot flow passage communicates with the regulator when all of the operation valves are determined to be in the neutral position on the basis of a detection result from the operating condition detector.

According to this invention, when all of a plurality of operation valves are determined to be in a neutral position, the oil discharged from the variable volume pump is led to the regenerative hydraulic motor, and therefore a standby flow of the variable volume pump can be used effectively. Further, a pressure acting on the regulator is controlled variably by the solenoid variable pressure reducing valve, and therefore the tilt angle of the variable volume pump can be controlled freely as required. As a result, situations in which there is not enough energy to charge a battery do not arise.

EMBODIMENTS OF THE INVENTION

A control device for a hybrid construction machine according to an embodiment of this invention will be described below with reference to the figures. In the following embodiment, a case in which the hybrid construction machine is a power shovel will be described.

Figure 1:
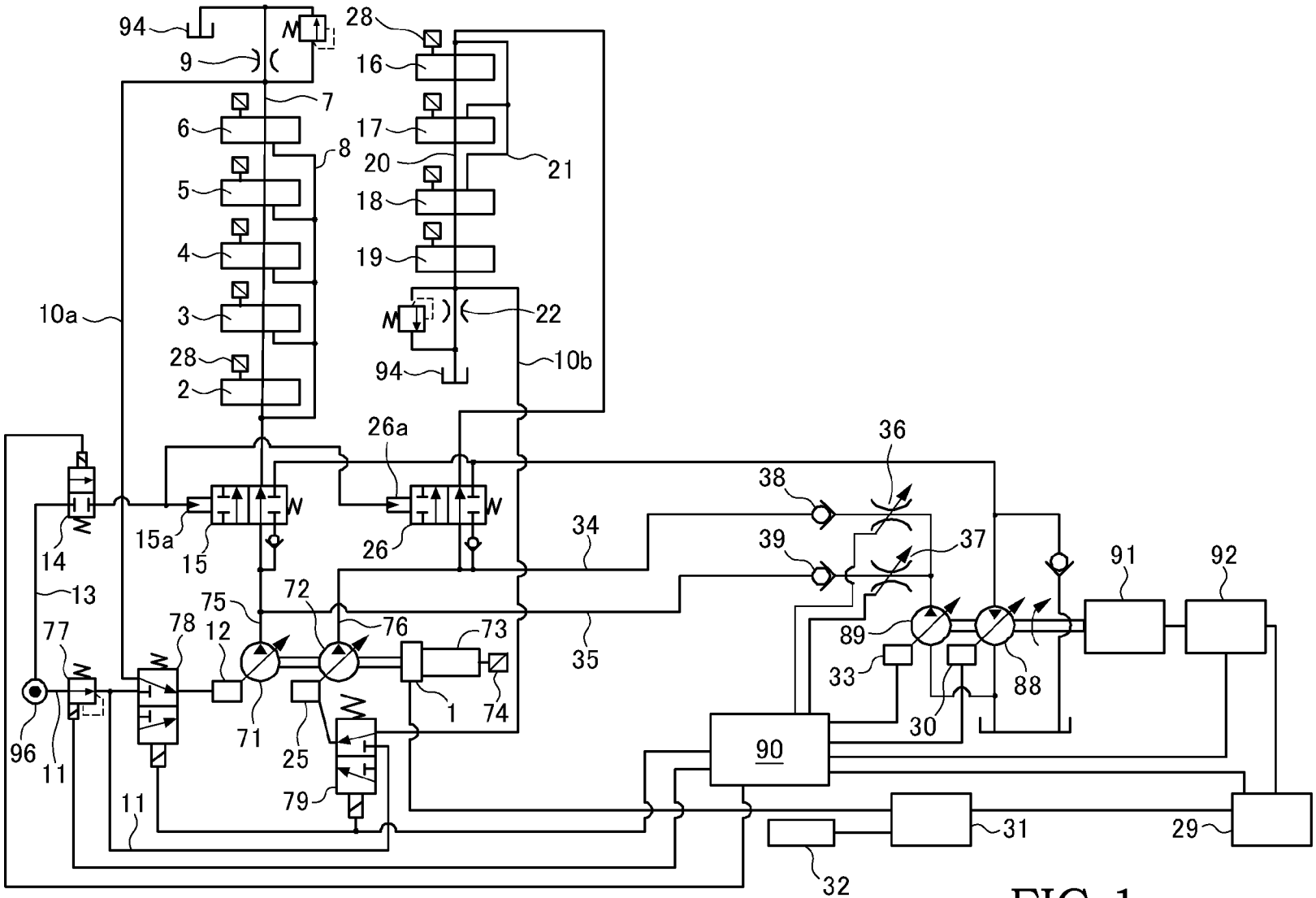
FIG. 1 is a circuit diagram of a control device for a hybrid construction machine according to an embodiment of this invention.

As shown in FIG. 1, the power shovel is provided with a first main pump 71 and a second main pump 72, which are variable volume type pumps that rotate using a driving force of an engine 73 serving as a prime mover. The first main pump 71 and the second main pump 72 rotate coaxially. The engine 73 is provided with a generator 1 that exhibits a power generation function using a surplus force of the engine 73. The engine 73 is also provided with a rotation speed sensor 74 serving as a rotation speed detector that detects a rotation speed of the engine 73.

A working oil discharged from the first main pump 71 is supplied to a first circuit system. The first circuit system includes, in order from an upstream side, an operation valve 2 that controls a turning motor, an operation valve 3 that controls an arm cylinder, a boom two-speed operation valve 4 that controls a boom cylinder, an operation valve 5 that controls a preliminary attachment, and an operation valve 6 that controls a first travel motor for leftward travel. The respective operation valves 2 to 6 control operations of respective actuators by controlling a flow of working oil led to the respective actuators from the first main pump 71.

A first main flow passage 75 through which the discharged working oil passes is connected to the first main pump 71. The first main flow passage 75 bifurcates into a neutral flow passage 7 and a parallel flow passage 8. The respective operation valves 2 to 6 are connected via the neutral flow passage 7 and the parallel flow passage 8. A first main switch valve 15 that leads the working oil discharged from the first main pump 71 selectively to the operation valves 2 to 6 or a regenerative hydraulic motor 88, to be described below, is provided in the first main flow passage 75.

A throttle 9 for generating a pilot pressure is provided in the neutral flow passage 7 on a downstream side of the operation valves 2 to 6. The throttle 9 generates a higher pilot pressure on an upstream side thereof as a flow passing through the throttle 9 increases, and generates a lower pilot pressure on the upstream side as the flow passing through the throttle 9 decreases.

When all of the operation valves 2 to 6 are in a neutral position or in the vicinity of the neutral position, the neutral flow passage 7 leads all or a part of the working oil discharged from the first main pump 71 to a tank 94 via the throttle 9. At this time, the flow passing through the throttle 9 is large, and therefore a high pilot pressure is generated.

When the operation valves 2 to 6 are switched to a full stroke condition, on the other hand, the neutral flow passage 7 is closed such that the fluid stops flowing. In this case, the flow passing through the throttle 9 is substantially eliminated, and therefore the pilot pressure is held at zero. Depending on an operation amount of the operation valves 2 to 6, however, a part of the working oil discharged from the first main pump 71 is led to an actuator while the remainder is led to the tank 94 through the neutral flow passage 7, and therefore the throttle 9 generates a pilot pressure that corresponds to the flow of the working oil through the neutral flow passage 7. In other words, the throttle 9 generates a pilot pressure that corresponds to the operation amount of the operation valves 2 to 6.

A first pilot flow passage 10*a* bifurcates from the neutral flow passage 7 between the furthest downstream operation valve 6 and the throttle 9. A pressure of the neutral flow passage 7 generated on the upstream side of the throttle 9 is led to the first pilot flow passage 10*a* as the pilot pressure. The first pilot flow passage 10*a* is connected to a regulator 12 that controls a tilt angle of the first main pump 71. The regulator 12 controls a displacement amount per revolution of the first main pump 71 by controlling the tilt angle of the first main pump 71 in inverse proportion to the pilot pressure in the first pilot flow passage 10*a*. Hence, when the operation valves 2 to 6 perform a full stroke such that the flow through the neutral flow passage 7 disappears and the pilot pressure in the first pilot flow passage 10*a* reaches zero, the tilt angle of the first main pump 71 reaches a maximum, thereby maximizing the displacement amount per revolution.

The power shovel is further provided with a pilot pump 96 serving as a pilot pressure source. A pilot pressure oil supplied by the pilot pump 96 is led to the regulator 12 through a second pilot flow passage 11. A first pilot selection valve 78 that connects one of the first pilot flow passage 10*a* and the second pilot flow passage 11 to the regulator 12 selectively is provided to straddle the first and second pilot flow passages 10*a*, 11. The first pilot selection valve 78 is connected by a solenoid to a controller 90, and is switched between a first position and a second position on the basis of an output signal from the controller 90. The first pilot selection valve 78 is set in the first position (a position shown in FIG. 1) in a normal condition where the solenoid is not excited and in the second position when the solenoid is excited. In the first position, the first pilot flow passage 10*a* is connected to the regulator 12 such that the regulator 12 controls the tilt angle of the first main pump 71 on the basis of a pilot pressure led from the first pilot flow passage 10*a*. In the second position, on the other hand, the second pilot flow passage 11 is connected to the regulator 12 such that the regulator 12 controls the tilt angle of the first main pump 71 on the basis of a pilot pressure led from the second pilot flow passage 11.

A solenoid variable pressure reducing valve 77 capable of variably controlling the pilot pressure that is led from the pilot pump 96 to act on the regulator 12 is provided in the second pilot flow passage 11. A solenoid of the solenoid variable pressure reducing valve 77 is connected to the controller 90 such that a secondary pressure serving as an outlet pressure of the solenoid variable pressure reducing valve 77 is controlled variably on the basis of an output signal from the controller 90. Hence, when the tilt angle of the first main pump 71 is controlled on the basis of the pilot pressure in the second pilot flow passage 11, the tilt angle can be set freely by controlling the secondary pressure of the solenoid variable pressure reducing valve 77.

The first main switch valve 15 is a pilot operated valve that is switched between a first position (a position shown in FIG. 1) and a second position on the basis of a pilot pressure led to a pilot chamber 15*a*. A pilot pressure oil supplied by the pilot pump 96 is led to the pilot chamber 15*a* through a third pilot flow passage 13.

A pilot solenoid switch valve 14 that is switched between a blocking position and a communicating position on the basis of an output signal from the controller 90 is provided in the third pilot flow passage 13. The pilot solenoid switch valve 14 is connected by a solenoid to the controller 90 and switched between the blocking position and the communicating position on the basis of an output signal from the controller 90. The pilot solenoid switch valve 13 is set in the blocking position (a position shown in FIG. 1) in a normal condition where the solenoid is not excited and in the communicating position when the solenoid is excited. When the pilot solenoid switch valve 14 is in the blocking position, the supply of pilot pressure oil from the pilot pump 96 to the pilot chamber 15*a* is blocked, and therefore the first main switch valve 15 is set in the first position, i.e. in a normal condition. As a result, the working oil discharged from the first main pump 71 is led to the operation valves 2 to 6. When the pilot solenoid switch valve 14 is in the communicating position, on the other hand, the pilot pressure oil is supplied to the pilot chamber 15*a* from the pilot pump 96, and therefore the first main switch valve 15 is set in the second position. As a result, the working oil discharged from the first main pump 71 is led to the regenerative hydraulic motor 88.

The second main pump 72 is connected to a second circuit system. The second circuit system includes, in order from an upstream side, an operation valve 16 that controls a second travel motor for rightward travel, an operation valve 17 that controls a bucket cylinder, an operation valve 18 that controls a boom cylinder, and an arm two-speed operation valve 19 that controls an arm cylinder. The respective operation valves 16 to 19 control operations of respective actuators by controlling a flow of working oil led to the respective actuators from the second main pump 72.

A second main flow passage 76 through which the discharged working oil passes is connected to the second main pump 72. The second main flow passage 76 bifurcates into a neutral flow passage 20 and a parallel flow passage 21. The respective operation valves 16 to 19 are connected via the neutral flow passage 20 and the parallel flow passage 21. A second main switch valve 26 that leads the working oil discharged from the second main pump 72 selectively to the operation valves 16 to 19 or the regenerative hydraulic motor 88 is provided in the second main flow passage 76.

A throttle 22 for generating a pilot pressure is provided in the neutral flow passage 20 on a downstream side of the operation valves 16 to 19. The throttle 22 functions identically to the throttle 9 on the first main pump 71 side.

A first pilot flow passage 10*b* is connected to the neutral flow passage 20 between the furthest downstream operation valve 19 and the throttle 22. A pressure of the neutral flow passage 20 generated on the upstream side of the throttle 22 is led to the first pilot flow passage 10*b* as the pilot pressure. The first pilot flow passage 10*b* is connected to a regulator 25 that controls a tilt angle of the second main pump 72. The regulator 25 controls a displacement amount per revolution of the second main pump 72 by controlling the tilt angle of the second main pump 72 in inverse proportion to the pilot pressure in the first pilot flow passage 10*b*. Hence, when the operation valves 16 to 19 perform a full stroke such that the flow through the neutral flow passage 20 disappears and the pilot pressure in the first pilot flow passage 10*b* reaches zero, the tilt angle of the second main pump 72 reaches a maximum, thereby maximizing the displacement amount per revolution.

The second pilot flow passage 11 bifurcates downstream of the solenoid variable pressure reducing valve 77 so as to connect to the regulator 25. A second pilot selection valve 79 that connects one of the first pilot flow passage 10*b* and the second pilot flow passage 11 to the regulator 25 selectively is provided to straddle the first and second pilot flow passages 10*b*, 11. The second pilot selection valve 79 is connected by a solenoid to the controller 90, and is switched between a first position (a position shown in FIG. 1) and a second position on the basis of an output signal from the controller 90. A constitution and an operation of the second pilot selection valve 79 are identical to those of the first pilot selection valve 78 on the first main pump 71 side.

The first pilot selection valve 78 and second pilot selection valve 79 are provided parallel to the second pilot flow passage 11 downstream of the solenoid variable pressure reducing valve 77, and therefore, when both valves are in the second position, an identical pilot pressure controlled by the solenoid variable pressure reducing valve 77 acts on the regulators 12 and 25.

The second main switch valve 26 is a pilot operated valve that is switched between a first position (a position shown in FIG. 1) and a second position on the basis of a pilot pressure led to a pilot chamber 26*a*. The third pilot flow passage 13 bifurcates downstream of the pilot solenoid switch valve 14 so as to connect to the pilot chamber 26*a*. Hence, when the pilot solenoid switch valve 14 is switched to the communicating position, the first main switch valve 15 and the second main switch valve 26 are switched such that the working oil discharged from the first main pump 71 and the second main pump 72 is led to the regenerative hydraulic motor 88.

A sensor 28 serving as a neutral position detector for electrically detecting a neutral position of the operation valves 2 to 6 is provided in each of the operation valves 2 to 6. Detection signals from the sensors 28 are output to the controller 90. On the basis of the detection signals from the sensors 28, the controller 90 determines whether or not all of the operation valves 2 to 6 are in the neutral position.

The sensor 28 corresponds to an operating condition detector for detecting an operating condition of the operation valves 2 to 6. The operating condition detector according to this invention is not limited to the sensor 28 for electrically detecting the neutral position of the operation valves 2 to 6, and a sensor that detects the neutral position of the operation valves 2 to 6 hydraulically may be used instead. More specifically, the operation valves 2 to 6 may be provided with a pilot passage that connects the valves in series such that when the operation valves 2 to 6 are switched from the neutral position to a switched position, the pilot passage is blocked, leading to variation in the pressure in the pilot passage. In this case, the pressure in the pilot passage is converted into an electric signal and output to the controller 90, whereupon the controller 90 determines, on the basis of the electric signal, whether or not all of the operation valves 2 to 6 are in the neutral position.

In another constitution for detecting the neutral position of the operation valves 2 to 6 hydraulically, a pressure gauge may be provided as the pressure detector for detecting the pressure in the first pilot flow passage 10*a*. A pressure signal detected by the pressure gauge is then output to the controller 90. The pilot pressure in the first pilot flow passage 10*a* varies in accordance with an operation amount of the operation valves 2 to 6, and therefore the controller 90 can determine whether or not all of the operation valves 2 to 6 are in the neutral position on the basis of the pressure signal detected by the pressure gauge. More specifically, a pressure generated upstream of the throttle 9 when all of the operation valves 2 to 6 are in the neutral position is stored in the controller 90 in advance as a set pressure. Then, when the pressure signal from the pressure gauge reaches the set pressure, the controller 90 determines that all of the operation valves 2 to 6 are in the neutral position.

Cases in which the neutral position detector detects the neutral position of the operation valves 2 to 6 were described above, but the above description applies likewise to the operation valves 16 to 19.

The regenerative hydraulic motor 88 rotates in conjunction with a power generator 91. The hydraulic motor 88 is a variable volume motor, a tilt angle of which is controlled by a regulator 30 connected to the controller 90. A power generated by the power generator 91 is charged to a battery 29 via an inverter 92. The battery 29 is connected to the controller 90 so that the controller 90 can check an amount of charge of the battery 29. The hydraulic motor 88 and the power generator 91 may be coupled directly or via a reduction gear.

The generator 1 provided in the engine 73 is connected to a battery charger 31 such that a power generated by the generator 1 is charged to the battery 29 via the battery charger 31. The battery charger 31 is also connected to a power supply 32 of a separate system, such as a household power supply.

An assist pump 89 is coupled to the hydraulic motor 88. The assist pump 89 rotates coaxially with the hydraulic motor 88. The assist pump 89 is a variable volume pump, a tilt angle of which is controlled by a regulator 33 connected to the controller 90. When the hydraulic motor 88 exhibits a power generation function, the tilt angle of the assist pump 89 is set at a minimum such that the assist pump 89 suppresses a load acting on the hydraulic motor 88. When the power generator 91 is caused to function as an electric motor, on the other hand, the assist pump 89 rotates so as to exhibit a pump function.

A working oil discharged from the assist pump 89 is led to the first main flow passage 75 and the second main flow passage 76 through assist flow passages 34, 35 provided in parallel. The assist flow passages 34, 35 are provided with flow control valves 36, 37, and check valves 38, 39 which allow the working oil to flow only from the assist pump 89 to the first main flow passage 75 and the second main flow passage 76.

When all of the operation valves 2 to 6, 16 to 19 are held in the neutral position, the controller 90 determines that the actuators connected to the operation valves 2 to 6, 16 to 19 are in an operative condition and does not therefore excite the solenoids of the first pilot selection valve 78, the second pilot selection valve 79, and the pilot solenoid switch valve 14. Hence, the respective valves are maintained in the normal condition shown in FIG. 1. In this condition, no pilot pressure acts on the pilot chambers 15*a*, 26*a*, and therefore the first main switch valve 15 and second main switch valve 26 are maintained in the normal position shown in FIG. 1. Accordingly, the working oil discharged from the first main pump 71 is supplied to the first circuit system and the working oil discharged from the second main pump 72 is supplied to the second circuit system.

In this condition, the flow through the neutral flow passages 7, 20 varies in accordance with the operation amount of the operation valves 2 to 6, 16 to 19. Further, the pilot pressure generated on the upstream side of the throttles 9, 22 varies in accordance with the flow through the neutral flow passages 7, 20. The regulators 12, 25 control the tilt angles of the first main pump 71 and the second main pump 72 in accordance with this pilot pressure. More specifically, the tilt angle is increased as the pilot pressure is lower, leading to an increase in the displacement amount per revolution of the first main pump 71 and second main pump 72. Conversely, the tilt angle is decreased as the pilot pressure is higher, leading to a reduction in the displacement amount per revolution of the first main pump 71 and second main pump 72. As a result, the first main pump 71 and second main pump 72 discharge flows that match a required flow corresponding to the operation amount of the operation valves 2 to 6, 16 to 19.

Further, when the regulator 33 of the assist pump 89 is controlled such that a working oil is discharged from the assist pump 89, the discharged oil is supplied to the first and second circuit systems after converging with the oil discharged by the first main pump 71 and second main pump 72. The assist pump 89 is rotated when the power generator 91 is caused to function as an electric motor, and the power charged to the battery 29 can be used to drive the assist pump 89. An output torque of the hydraulic motor 88 can also be used as a drive source for rotating the assist pump 89.

Figure 2A:
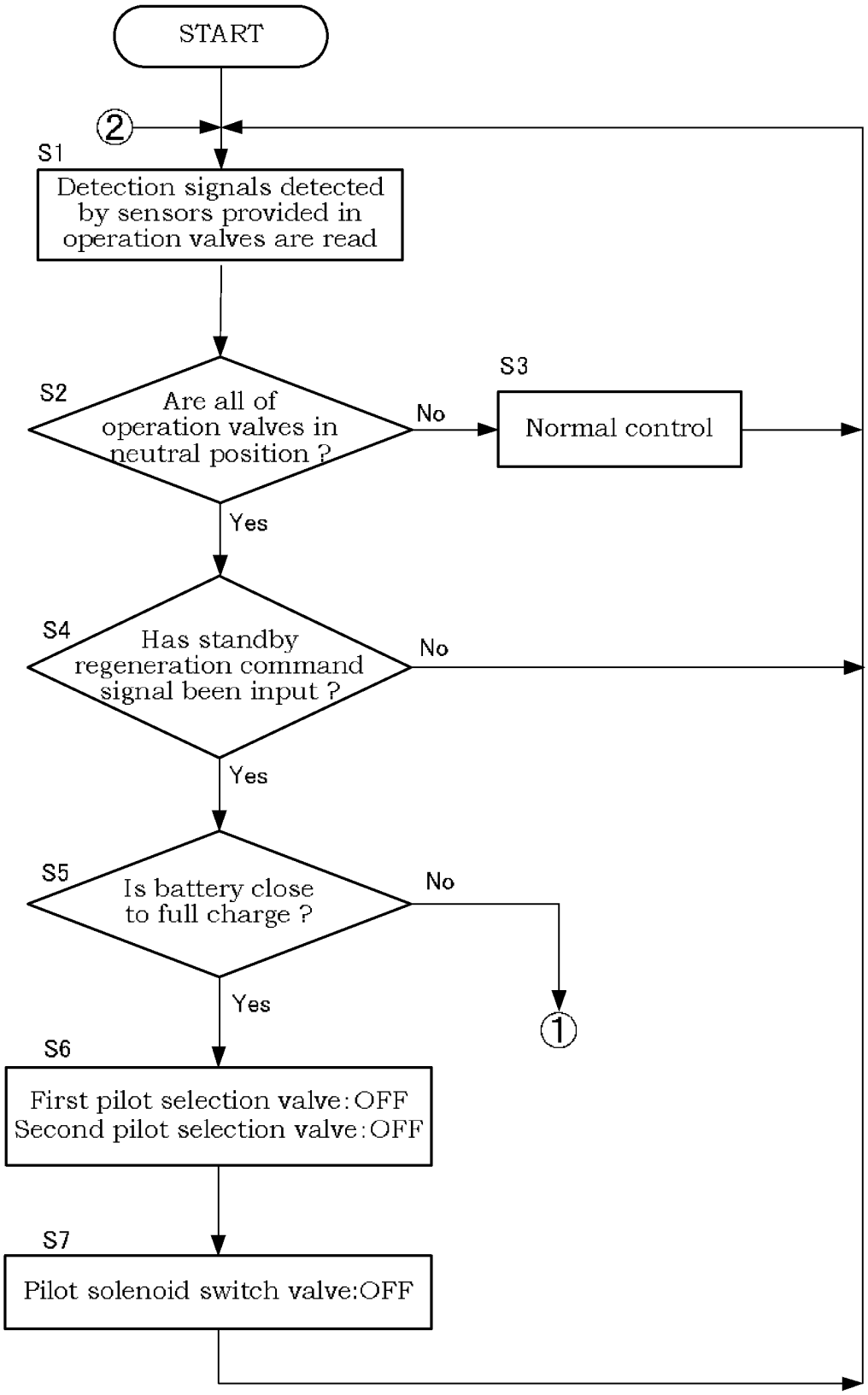
FIGS. 2A and 2B are flowcharts showing control procedures executed by a controller.
Figure 2B:
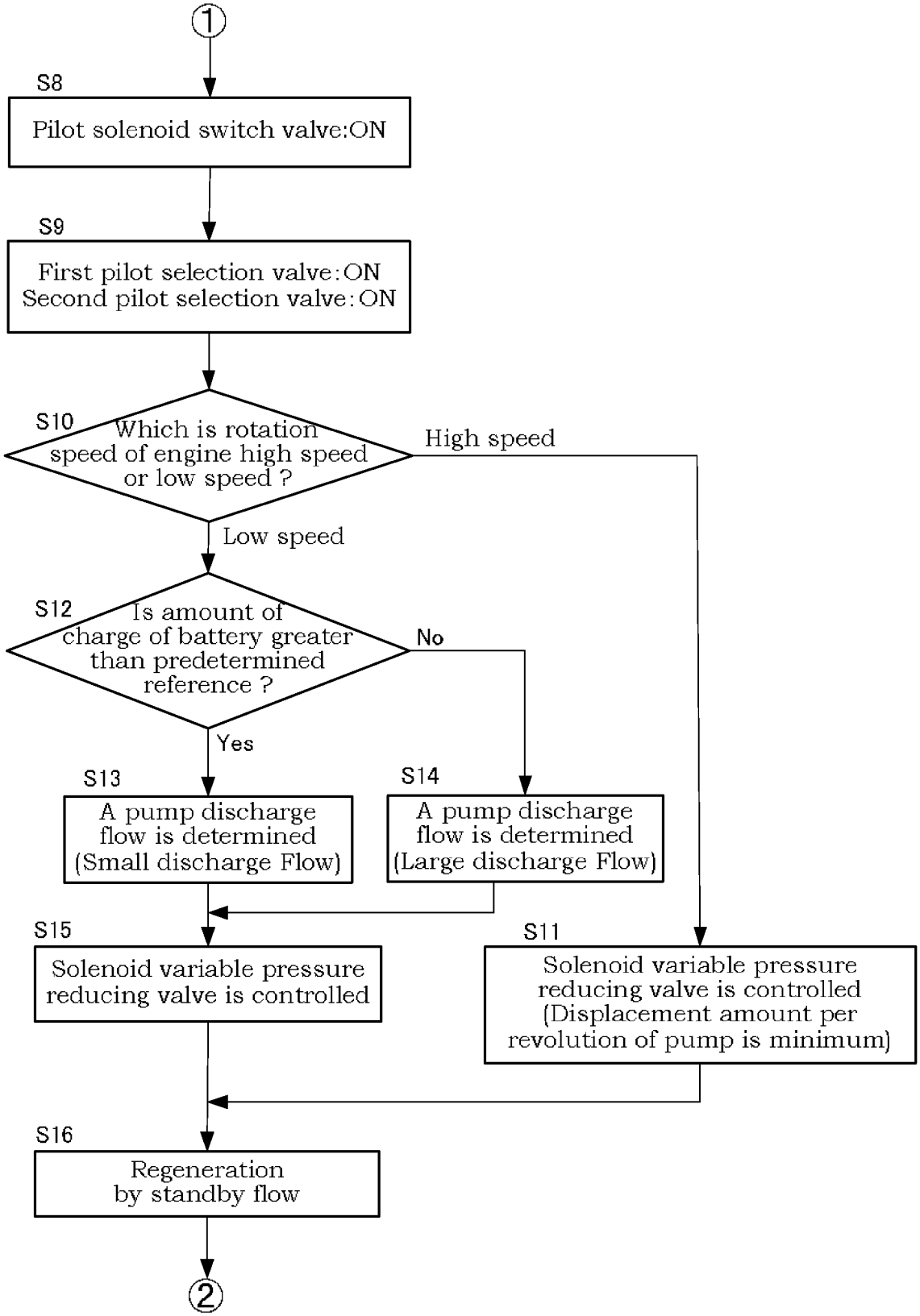

Next, referring to FIGS. 2A and 2B, control procedures executed by the controller 90 will be described. A CPU for controlling an overall processing operation of the control device, a program required in the processing operation of the CPU, a ROM storing data and the like, a RAM that stores data read from the ROM, data read by various measuring instruments, and so on temporarily, and so on are stored in the controller 90.

In a step 1, the detection signals detected by the sensors 28 provided in the operation valves 2 to 6, 16 to 19 are read.

In a step 2, a determination is made on the basis of the detection signals from the sensors 28 as to whether or not all of the operation valves 2 to 6, 16 to 19 are in the neutral position. When it is determined in the step 2 that any one of the operation valves 2 to 6, 16 to 19 is in the switched position rather than the neutral position, the actuator connected to the corresponding operation valve is determined to be operative, and therefore the routine advances to a step 3, in which normal control is continued. The routine then returns to the step 1.

When it is determined in the step 2 that all of the operation valves 2 to 6, 16 to 19 are in the neutral position, the respective actuators are determined to be in an inoperative condition, whereupon the routine advances to a step 4.

To charge the battery 29 by rotating the hydraulic motor 88, a power generation request must be issued by an operator. The operator issues a power generation request by operating a power generation request switch, and when the switch is operated, a standby regeneration command signal is input into the controller 90. Hence, in the step 4, a determination is made as to whether or not the standby regeneration command signal has been input. When it is determined in the step 4 that the standby regeneration command signal has not been input, the routine returns to the step 1.

When it is determined in the step 4 that the standby regeneration command signal has been input, the routine advances to a step 5. In the step 5, a determination is made as to whether or not the battery 29 is close to full charge.

When it is determined in the step 5 that the amount of charge of the battery 29 is close to full charge, the routine advances to a step 6 and a step 7. In the step 6 and the step 7, the solenoids of the first pilot selection valve 78 and second pilot selection valve 79 are maintained in a non-excited condition and the solenoid of the pilot solenoid switch valve 14 is maintained in a non-excited condition. As a result, the respective valves are maintained in the normal positions shown in FIG. 1, whereupon the routine returns to the step 1. When all of the first pilot selection valve 78, the second pilot selection valve 79, and the pilot solenoid switch valve 14 are held in their normal positions, the oil discharged from the first main pump 71 and the second main pump 72 passes through the neutral flow passages 7, 20 and the first pilot flow passages 10*a*, 10*b* from the first main switch valve 15 and the second main switch valve 26, and is led to the regulators 12, 25 from the first pilot selection valve 78 and the second pilot selection valve 79. The regulators 12, 25 then control the tilt angles of the first main pump 71 and the second main pump 72 using the pilot pressure generated upstream of the throttles 9, 22. As a result, the oil discharged from the first main pump 71 and the second main pump 72 is maintained at a standby flow, and this standby flow is returned to the tank 94 via the throttles 9, 22.

When it is determined in the step 5 that the amount of charge of the battery 29 is not close to full charge, or in other words that the amount of charge is insufficient, the routine advances to a step 8. In the step 8, the solenoid of the pilot solenoid switch valve 14 is excited such that the pilot solenoid switch valve 14 is switched from the blocking position, i.e. the normal position, to the communicating position. As a result, the pilot pressure oil is supplied from the pilot pump 96 to the pilot chambers 15*a*, 26*a* of the first main switch valve 15 and the second main switch valve 26, whereby the first main switch valve 15 and the second main switch valve 26 are switched from the first position, i.e. the normal position, to the second position. Accordingly, the working oil discharged from the first main pump 71 and the second main pump 72 is led to the hydraulic motor 88.

In a step 9, the solenoids of the first pilot selection valve 78 and the second pilot selection valve 79 are excited such that the first pilot selection valve 78 and the second pilot selection valve 79 are switched from the first position, i.e. the normal position, to the second position. As a result, communication between the first pilot flow passages 10*a*, 10*b* and the regulators 12, 25 is blocked, and the second pilot flow passage 11 communicates with the regulators 12, 25. The regulators 12, 25 then control the tilt angles of the first main pump 71 and the second main pump 72 on the basis of the pilot pressure led from the second pilot flow passage 11.

In a step 10, a determination is made as to whether the rotation speed of the engine 73 detected by the rotation speed sensor 74 is a high speed or a low speed. More specifically, the rotation speed detected by the rotation speed sensor 74 is determined to be a low speed when equal to or lower than a predetermined set rotation speed and a high speed when higher than the set rotation speed. The set rotation speed is stored in advance in the ROM of the controller 90.

When the rotation speed of the engine 73 is determined to be a high speed in the step 10, the routine advances to a step 11. In the step 11, the solenoid variable pressure reducing valve 77 is controlled to set the secondary pressure such that the displacement amount per revolution of the first main pump 71 and the second main pump 72 is close to a minimum. The reason for setting the displacement amount per revolution of the pumps close to the minimum when the rotation speed of the engine 73 is a high speed in this manner is that a discharge flow per unit time of the first main pump 71 and the second main pump 72 can be secured even though the displacement amount per revolution of the pumps is small. After the step 11, the routine advances to a step 16, to be described below.

When the rotation speed of the engine 73 is determined to be a low speed in the step 10, the routine advances to a step 12, in which the amount of charge of the battery 29 is determined. More specifically, a determination is made as to whether or not the amount of charge of the battery 29 is equal to or greater than a predetermined reference amount of charge. The reference amount of charge is stored in advance in the ROM of the controller 90.

When it is determined in the step 12 that the amount of charge of the battery 29 is equal to or greater than the reference amount of charge, the routine advances to a step 13. In the step 13, a required amount of charge is calculated on the basis of the current amount of charge of the battery 29, and a pump discharge flow corresponding to the required amount of charge is determined. When it is determined in the step 12 that the amount of charge of the battery 29 is smaller than the reference amount of charge, on the other hand, the routine advances to a step 14. In the step 14, similarly to the step 13, the required amount of charge is calculated on the basis of the current amount of charge of the battery 29, and the pump discharge flow corresponding to the required amount of charge is determined. Here, the pump discharge flow determined in the step 13 is smaller than the pump discharge flow determined in the step 14.

After determining the pump discharge flows in the steps 13 and 14, the routine advances to a step 15. In the step 15, the secondary pressure of the solenoid variable pressure reducing valve 77 is controlled by adjusting an excitation current applied to the solenoid of the solenoid variable pressure reducing valve 77. Accordingly, the controlled secondary pressure of the solenoid variable pressure reducing valve 77 acts on the regulators 12, 25, and as a result, the tilt angles of the first main pump 71 and the second main pump 72 are set such that the discharge flows thereof match the pump discharge flows determined in the steps 13 and 14. Hence, the first main pump 71 and the second main pump 72 discharge flows required to charge the battery 29 to the required amount of charge calculated in the steps 13 and 14.

Hence, by controlling the secondary pressure of the solenoid variable pressure reducing valve 77, the discharge flows of the first main pump 71 and the second main pump 72 are controlled in the manner described above. Further, when the hydraulic motor 88 is rotated in accordance with the discharge flows, power generation is performed by the power generator 91. The power generated by the power generator 91 is charged to the battery 29 via the inverter 92. As a result, regeneration is performed using the standby flow discharged from the first main pump 71 and the second main pump 72 (step 16).

In the above description, regeneration is performed using the standby flow when all of the operation valves 2 to 6, 16 to 19 of the first and second circuit systems are held in the neutral position. However, the hydraulic motor 88 may be rotated such that regeneration is performed using the standby flow when either the first circuit system or the second circuit system is in the neutral position, or more specifically when either all of the operation valves 2 to 6 or all of the operation valves 16 to 19 are in the neutral position. In other words, the hydraulic motor 88 is rotated such that power generation is performed by the power generator 91 whenever the oil discharged from either the first main pump 71 or the second main pump 72 is supplied to the hydraulic motor 88.

The following actions and effects are obtained from the above embodiment.

When it is determined that all of the operation valves 2 to 6, 16 to 19 are in the neutral position, the oil discharged from the first main pump 71 and the second main pump 72 is led to the regenerative hydraulic motor 88, and therefore the standby flow of the first main pump 71 and the second main pump 72 can be used effectively.

Further, the pressure acting on the regulators 12, 25 is controlled variably by the solenoid variable pressure reducing valve 77, and therefore the tilt angles of the first main pump 71 and the second main pump 72 can be controlled freely as required. Hence, situations in which there is not enough energy to charge the battery 29 do not arise.

Furthermore, when the rotation speed of the engine 73 is a low speed, the first main pump 71 and the second main pump 72 are controlled such that the displacement amounts thereof per revolution increase. As a result, a pump efficiency can be improved and energy loss can be suppressed.

Moreover, since the tilt angles of the first main pump 71 and the second main pump 72 can be controlled freely, there is no need to increase the rotation speed of the engine 73 in order to increase the discharge flows of the first main pump 71 and the second main pump 72, and therefore energy loss can be suppressed.

Furthermore, since the first main pump 71 and second main pump 72 are connected directly to the hydraulic motor 88 via the first main switch valve 15 and second main switch valve 26, there is no need to provide special valves between the first main pump 71 and second main pump 72 and the hydraulic motor 88. As a result, a circuit configuration can be simplified.

It should be noted that in the above embodiment, the first main switch valve 15 and the second main switch valve 26 are pilot operated valves that are switched between the first position and the second position on the basis of the pilot pressure led to the pilot chamber 15*a* and the pilot chamber 26*a*. However, the first main switch valve 15 and the second main switch valve 26 may be constituted by solenoid valves that are switched between the first position and the second position on the basis of output signals from the controller 90. In this case, the third pilot flow passage 13 and the pilot solenoid switch valve 14 are not required.

This invention is not limited to the embodiment described above, and various amendments and modifications may be applied within the scope of the technical spirit of the invention, such amendments and modifications being included within the technical scope of the invention.

With regard to the above description, the contents of application No. 2009-164278, with a filing date of Jul. 10, 2009 in Japan, are incorporated herein by reference.

INDUSTRIAL APPLICABILITY

This invention can be used as a control device for a construction machine such as a power shovel.

The invention claimed is:

1. A control device for a hybrid construction machine, comprising:

a variable volume pump;

a plurality of operation valves that control a flow of a working oil led to respective actuators from the variable volume pump;

a neutral flow passage that leads the oil discharged from the variable volume pump to a tank when the operation valves are in a neutral position;

a pilot pressure generating throttle provided in the neutral flow passage on a downstream side of the operation valves;

a first pilot flow passage to which a pressure generated on an upstream side of the pilot pressure generating throttle is led;

a regulator that performs control such that a tilt angle of the variable volume pump increases as an exerted pilot pressure decreases;

an operating condition detector that detects an operating condition of the operation valves;

a regenerative hydraulic motor rotated by the oil discharged from the variable volume pump;

a power generator connected to the hydraulic motor;

a main switch valve that leads the working oil discharged from the variable volume pump selectively to the operation valves or the hydraulic motor;

a second pilot flow passage that leads a pilot pressure oil supplied from a pilot pressure source to the regulator;

a pilot selection valve that connects the first pilot flow passage or the second pilot flow passage to the regulator selectively;

a solenoid variable pressure reducing valve that is provided in the second pilot flow passage to be capable of variably controlling a pilot pressure led from the pilot pressure source and exerted on the regulator; and a controller that switches the main switch valve such that the oil discharged from the variable volume pump is led to the hydraulic motor and switches the pilot selection valve such that the second pilot flow passage communicates with the regulator when all of the operation valves are determined to be in the neutral position on the basis of a detection result from the operating condition detector.

2. The control device for a hybrid construction machine as defined in claim 1, wherein the main switch valve is a pilot operated valve switched by the pilot pressure oil supplied from the pilot pressure source, the control device further comprises:

a third pilot flow passage that leads the pilot pressure oil supplied from the pilot pressure source to a pilot chamber of the main switch valve; and a pilot solenoid switch valve that is provided in the third pilot flow passage and switched to a blocking position or a communicating position on the basis of an output signal from the controller, and the controller switches the main switch valve by setting the pilot solenoid switch valve to the communicating position when all of the operation valves are determined to be in the neutral position.

3. The control device for a hybrid construction machine as defined in claim 1, wherein the solenoid variable pressure reducing valve is capable of controlling the pilot pressure exerted on the regulator from a pressure for keeping the variable volume pump at a minimum tilt angle to a pressure for keeping the variable volume pump at a maximum tilt angle on the basis of an output signal from the controller.

4. The control device for a hybrid construction machine as defined in claim 1, further comprising:

a prime mover that drives the variable volume pump; and a rotation speed detector that detects a rotation speed of the prime mover, wherein, the controller controls a secondary pressure of the solenoid variable pressure reducing valve such that a displacement amount per revolution of the variable volume pump reaches a minimum when all of the operation valves are determined to be in the neutral position and the rotation speed detected by the rotation speed detector exceeds a predetermined set rotation speed.

5. The control device for a hybrid construction machine as defined in claim 1, further comprising a battery that is charged with power generated as the hydraulic motor rotates, wherein the controller calculates a required amount of charge on the basis of a amount of charge of the battery, determines a discharge flow of the variable volume pump corresponding to the calculated required amount of charge, and controls the secondary pressure of the solenoid variable pressure reducing valve such that the discharge flow of the variable volume pump matches the determined discharge flow when all of the operation valves are determined to be in the neutral position.

* * * * *